US006990749B2

(12) United States Patent
Roesler et al.

(10) Patent No.: US 6,990,749 B2
(45) Date of Patent: Jan. 31, 2006

(54) MODULAR PAINT OVEN

(75) Inventors: Bruce Roesler, Wixom, MI (US); Lawrence A. Cook, Commerce Township, MI (US); Douglas G. Smith, Livonia, MI (US); David J. Cole, Canton, MI (US); Jeffrey C. Andrews, Dearborn, MI (US)

(73) Assignee: Dürr Industries, Inc., Plymouth, MI (US)

( * ) Notice: Subject to any disclaimer, the term of this patent is extended or adjusted under 35 U.S.C. 154(b) by 0 days.

(21) Appl. No.: 10/798,099

(22) Filed: Mar. 11, 2004

(65) Prior Publication Data

US 2004/0209217 A1 Oct. 21, 2004

Related U.S. Application Data

(60) Provisional application No. 60/453,560, filed on Mar. 11, 2003.

(51) Int. Cl.
*F26B 25/06* (2006.01)

(52) U.S. Cl. ..... 34/201; 34/666; 34/225; 34/233; 34/270; 34/272

(58) Field of Classification Search ..... 34/666, 34/225, 233, 270, 272; 432/35; 52/79.1, 52/125.2, 745.03
See application file for complete search history.

(56) References Cited

U.S. PATENT DOCUMENTS

| | | | | |
|---|---|---|---|---|
| 3,844,083 | A * | 10/1974 | Farley, Jr. | 52/645 |
| 3,851,427 | A * | 12/1974 | Lacoste, III | 52/79.4 |
| 4,731,016 | A | 3/1988 | Dixon | |
| 5,568,692 | A | 10/1996 | Crompton et al. | |

FOREIGN PATENT DOCUMENTS

| | | |
|---|---|---|
| DE | 2 213 888 | 10/1973 |
| DE | 9 306 821 | 7/1993 |
| DE | 1 985 8305 | 4/2000 |
| EP | 0 095 717 | 12/1983 |
| EP | 0 867 674 | 9/1998 |
| EP | 1 125 639 | 8/2001 |
| GB | 199 836 | 7/1923 |

OTHER PUBLICATIONS

PCT/US2004/007415 International Search Report.

* cited by examiner

*Primary Examiner*—Kenneth Rinehart
(74) *Attorney, Agent, or Firm*—Howard & Howard

(57) ABSTRACT

An oven assembly for drying paint on a product transported by a conveyor includes a plurality of modules positioned in a generally abutting relationship. Each of the modules includes a roof, side walls, and a floor having a length and a width. The floor is formed from abutting floor panels reinforced by a plurality of support members spaced along the length of the floor and having a length greater than the width of the floor. The side walls include an inner side wall panel disposed in an overlapping relationship with the floor and a side wall cladding panel supported by the support members along the width of the floor thereby concealing thermal insulating material disposed between the inner side wall panel and the side wall cladding panel.

42 Claims, 7 Drawing Sheets

MODULAR PAINT OVEN

RELATED APPLICATIONS

This application claims priority to U.S. Provisional Patent Application No. 60/453,560 filed Mar. 11, 2003.

BACKGROUND OF THE INVENTION

Automotive and industrial paint are typically baked at temperatures between 200 and 400° F. in ovens positioned at the end of paint application booths in production painting facilities. These ovens typically include an oven housing that encloses heating apparatus for applying either radiant or convection heating as is known to those of skill in the art.

Preferably, these ovens are constructed from modules that are manufactured at a fabricating facility and transferred to the production paint facility. The modules are then affixed together to form the oven housing through which a conveyor transfers the products that have been painted. A typical module includes side walls, a roof and a floor, and has a length of between about 20 and 40 feet. Thermal insulation is sandwiched between inner and outer panels to prevent heat from escaping from the housing while in operation. Present designs include significant structural components that have proven to unnecessarily add cost to the construction of the oven. Structural members are welded to wall panels in both vertical and horizontal directions prior to applying the outer panels. These structural members, which are fashioned from heavy gauge steel, add a significant amount of material costs to the oven, which has proven unnecessary, particularly in light of increasing steel costs.

A typical automotive paint oven is known to be up to several hundred feet long. Thus, unnecessary structural components included in each module will add cost to the oven several times over. Therefore, a simple construction that reduces unnecessary structural components would be desirable to reduce the overall material usage and cost of the oven.

SUMMARY OF THE INVENTION

The present invention relates to an oven assembly for drying paint on a product transported by a conveyor. A plurality of modules are positioned in a generally abutting relationship, each having a roof, side walls, and a floor defining a length and a width. The floor is formed from abutting floor panels reinforced by a plurality of support members spaced along the length of the floor. The support members have a length greater than the width of the floor. The side walls include an inner side wall panel disposed in an overlapping relationship with the floor and a side wall cladding panel supported by the support members along the width of the floor concealing thermal insulating material disposed between the inner side wall panel and the side wall cladding panel.

It has been determined that the heavy structural members associated with prior art ovens are not necessary, primarily because the oven does not provide structural support but merely retains heat to cure the coating applied to the product. Therefore, the present invention provides a light weight alternative that is easily manufactured at a remote location and transferred to the location intended for use.

DETAILED DESCRIPTION OF THE PREFERRED EMBODIMENT

Figure 1:
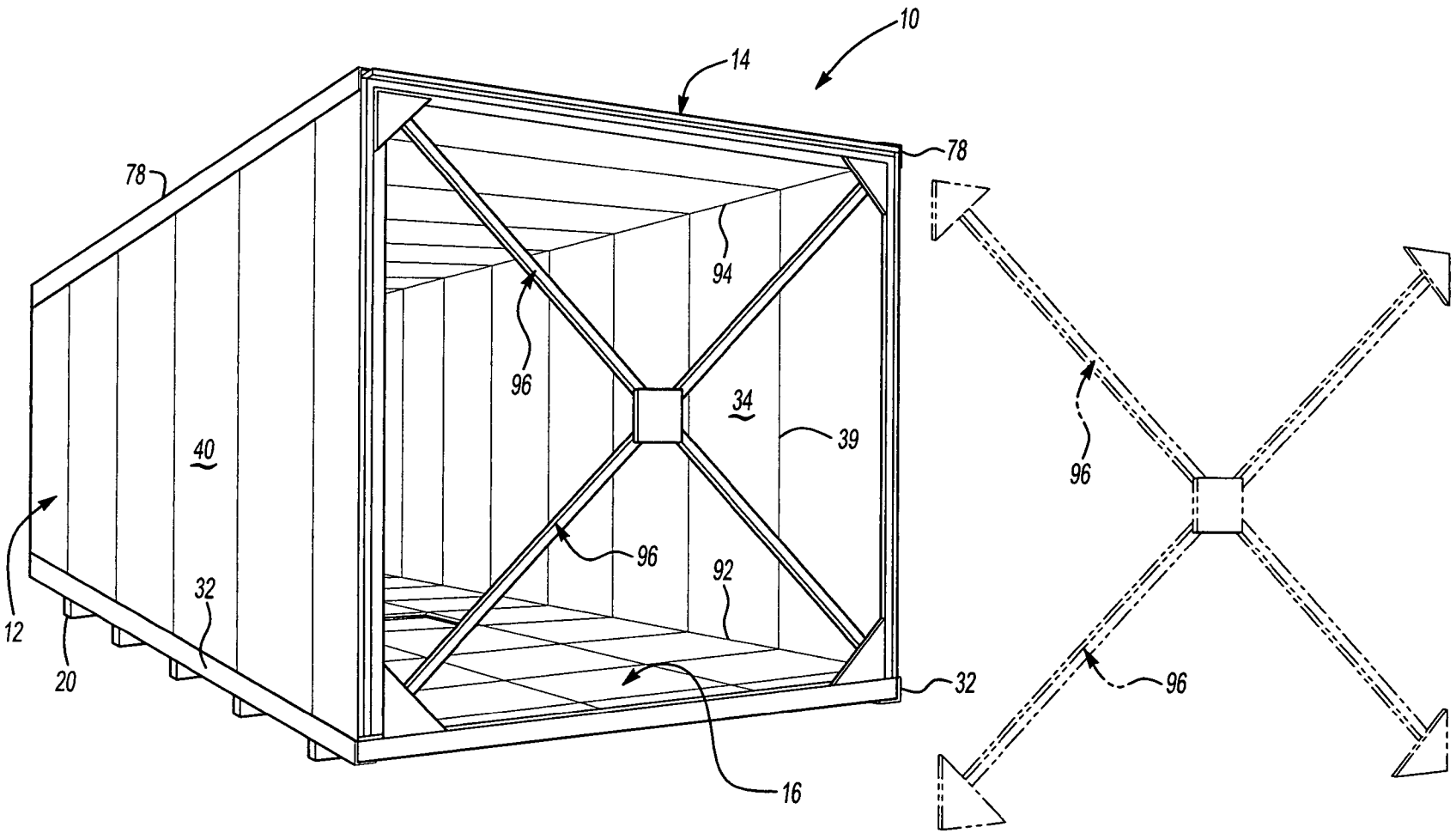
FIG. 1 shows a perspective view of the inventive oven module.
Figure 1A:
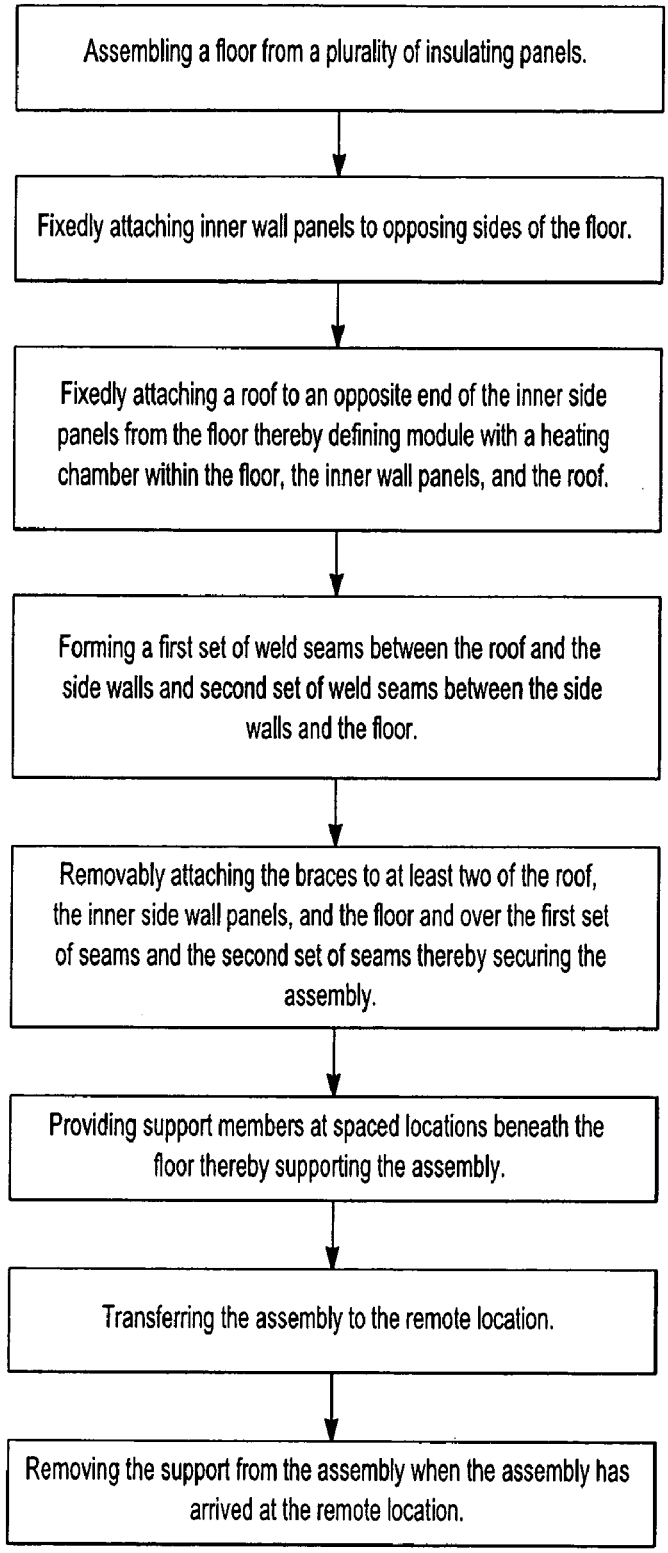
FIG. 1A shows a schematic view of the method of manufacturing an oven module for drying paint on products.

An oven module of the present invention is generally shown at 10 in FIG. 1. The module 10 includes side walls 12, a roof 14, and a floor 16.

Figure 2A:
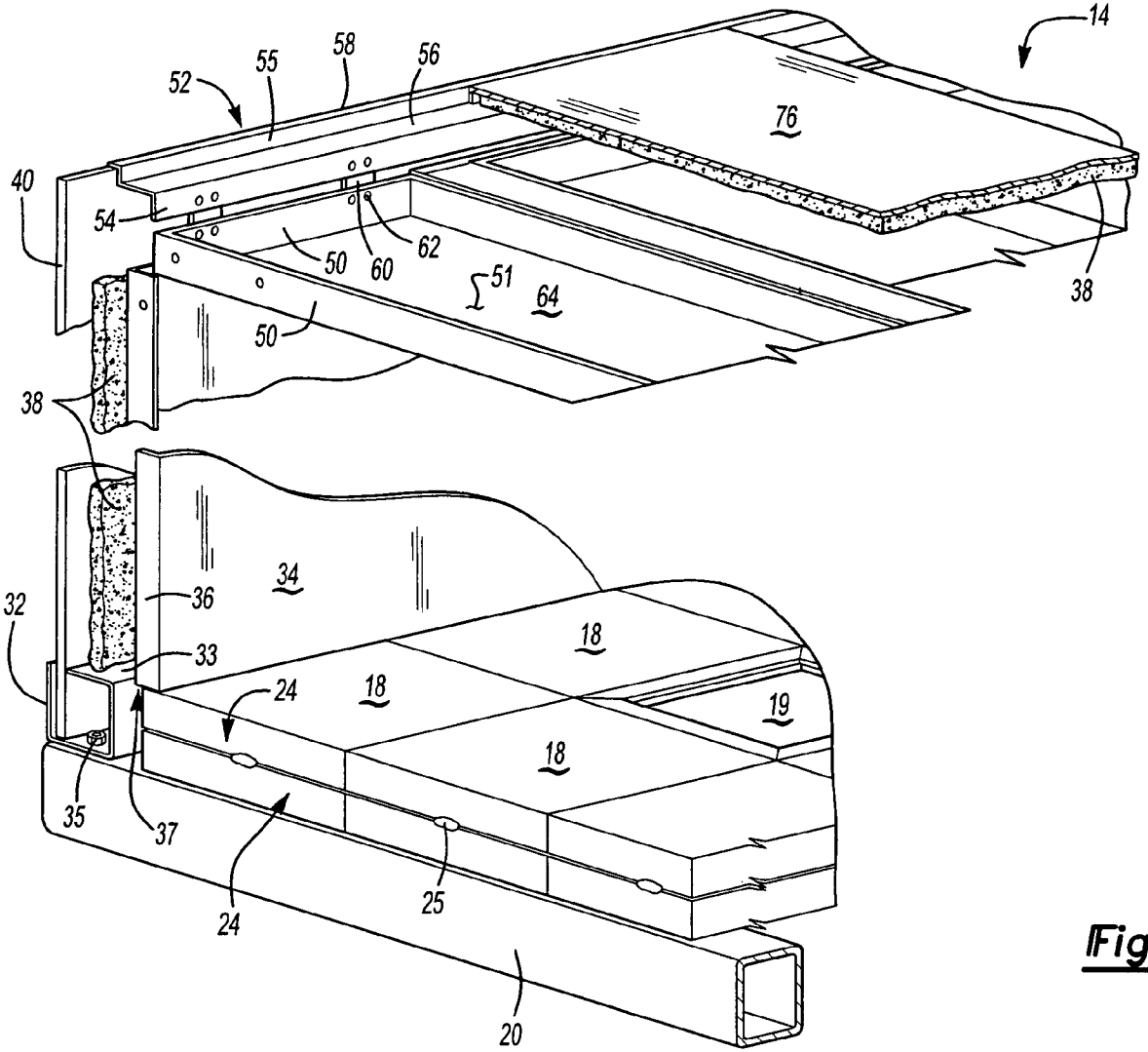
FIG. 2A shows a partial perspective view showing the intersection of the walls, floor, and roof of the inventive oven module.
Figure 2B:
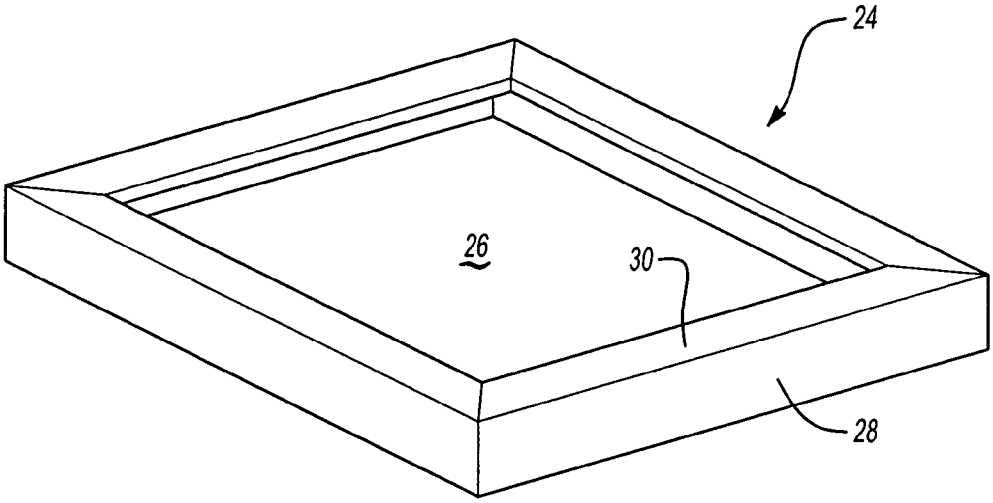
FIG. 2B shows a perspective view of a floor panel.

As best shown in FIGS. 2A and 2B, the floor is fabricated from a plurality of floor modules 18. The floor modules 18 are generally rectangular in shape and preferably are arranged longitudinally with respect to the length of the oven module 10. Preferably, three rows of floor modules 18 are positioned in an abutting relationship to form the entirety floor 16 (see also FIG. 1). The floor modules 18 are supported by support member 20 that extend across the width of the oven module 10 preferably positioned beneath the seam 22 formed between abutting floor modules 18. A hot air inlet 19 is disposed in the floor 16, the purpose of which will be explained further below.

Each floor module 18 is formed from two floor panels 24, one of which is best represented in FIG. 2B. Each floor panel 24 includes a panel base 26 having an upward extending panel flange 28 that is generally perpendicular to the panel base 26. Each panel flange 28 terminates in a terminal flange 30 that is generally perpendicular to the panel flange 28 so that the floor panel 24 defines a box-like structure. Each floor panel 24 is filled with thermal insulating material (not shown) and mated to a second floor panel 24 so that the terminal flanges 30 of the two panels 24 abut enclosing the box-like sections and sealing the thermal insulating material inside. The two floor panels 24 are either spat or stitch welded 25 together at the seam defined by the abutting terminal flanges 30 to form the floor module 18. The combination of the box like structures 24 and the support members 20 provide ample structural support to the assembly 10.

The support member 20 has a length that exceeds the width of the three abutting floor panels 24 as best shown in FIGS. 1 and 2A. A generally U-shaped channel 32 is secured to opposing ends of the support member 20 that extend beyond the width of the floor 16. The U-shaped channel 32 includes an upper, horizontal lip 33 that partially encloses the U-shaped channel 32. The U-shaped channel 32 extends along the length of the oven module 10, the purpose of which will be explained further below. The interaction between the floor panels 24, the support member 20, and the U-shaped channel 32 is shown best in FIG. 2A. Preferably, the U-shaped channel 32 is bolted or similarly fastened to each of, or some of, the support members 20 with fastener 35.

Referring again to FIG. 2A, the side wall 12 is formed from a plurality of side wall panels 34 each having a panel base 37 with a flange 36 extending outwardly from the panel 34 at a generally 90 degree angle defining the perimeter of the panel 34. The flange 36 defines a box-like enclosure with the panel base 37 to receive thermal insulating material 38. The insulating material is fastened to the side wall panels 34 with a welded pin (not shown) having a washer disposed upon a distal end.

The side wall panels 34 define the interior surface of the side wall 12 of the oven module housing 10. The side wall panels 34 are positioned inboard of the generally U-shaped channel 32 in an overlapping relationship with a side edge of the floor modules 18 defining the longitudinal sides of the floor 16 as best shown in FIG. 2A. The side wall panels 34 are welded or otherwise secured to the floor 16 as will be described further below. It should be understand that adjacent wall panels 34 are also welded together at the seam 39 (FIG. 1) defined by abutting wall panels 34 so that an airtight side wall 12 is formed.

Figure 3:
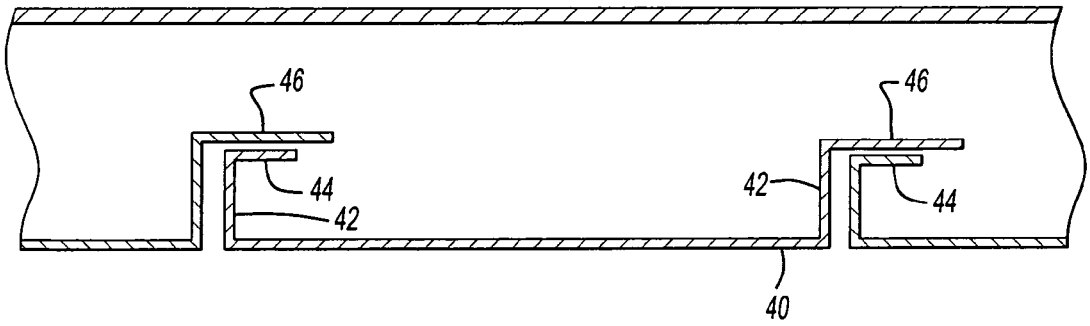
FIG. 3 top sectional view of inner wall and the outer wall cladding.

Cladding panels 40 are received by the generally U-shaped channel 32 to cover the thermal insulating material 38 retained by the side wall panels 34. The horizontal lip 33 pinches the cladding panels 40 to the U-shaped channel 32 to secure the cladding panels 40 to the module 10. The side wall cladding panels 40 are positioned in an abutting relationship to fully conceal the thermal insulating material 38, but are not otherwise adjoined by welding or fastening. However, metal screws (not shown) may be used to provide additional retention to the wall panels 34. As best shown in FIG. 3, a side flange 42 extends along vertical edges of each cladding panel 40 in a generally perpendicular relationship to a cladding panel base 40 in a direction facing the inner side wall panels 34. A first terminal flange 44 extends in an inboard direction from one of the side flanges 42 at generally perpendicular relationship and a second terminal flange 46 extends in an outboard direction from of the other side flange 42, also in a generally perpendicular relationship to the side flange. The first terminal flange 44 and the second terminal flange 46 of adjacent cladding panels 40 overlap enclosing the seam formed by the abutting cladding panels 40 to prevent the thermal insulating material 38 from becoming exposed during the varying thermal expansion and contraction of the adjacent cladding panels 40, which could result in a gap between the adjacent cladding panels 40.

Figure 4:
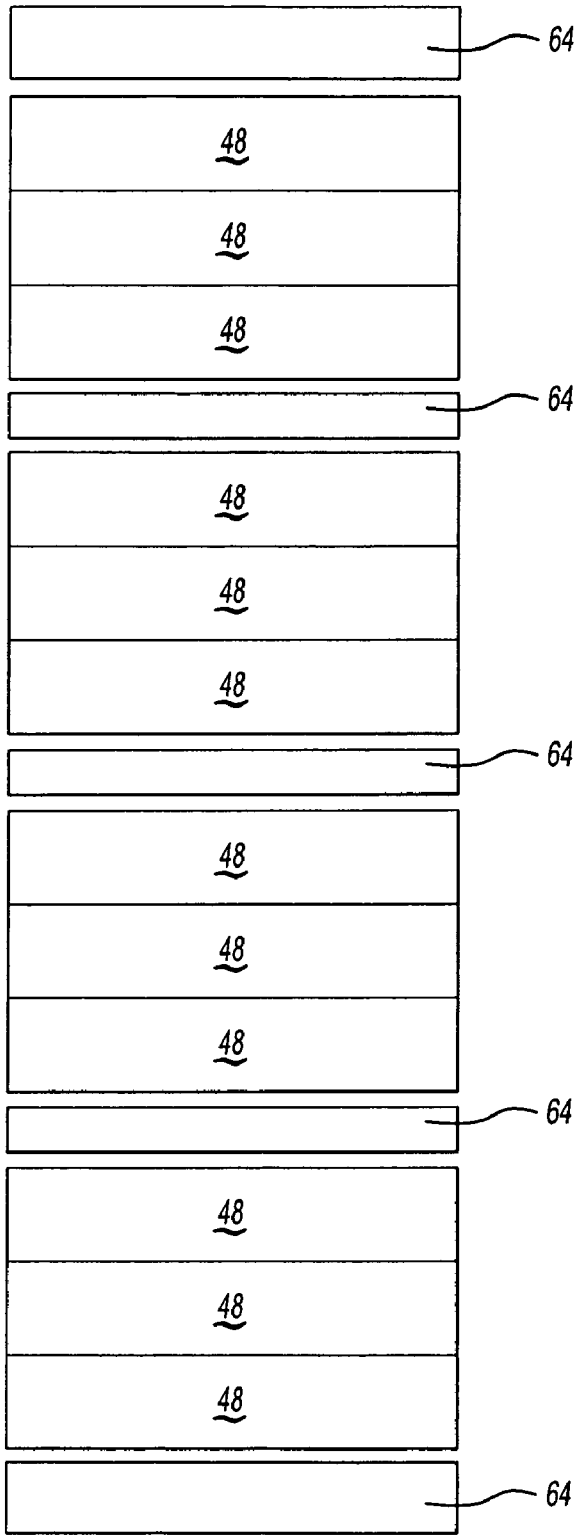
FIG. 4 shows a partial top view of a preferred layout roof panels and explosion panels.

Referring now to FIGS. 2A and 4, the roof 14 of the oven module 10 is formed from roof panels 64, and explosion panels 48 that are generally rectangular, the length of which is oriented to extend between each of the side walls 12. A roof flange 50 extends upwardly from a roof panel base 51 along the perimeter of each of the roof panels 64. A support member 52 extends along the entire length of the oven module 10 along the intersection between each side wall 12 and the roof 14. The support member 52 includes an inner vertical support wall 54, a first horizontal wall 56 and a second horizontal wall 58, each of which are generally perpendicular to the inner vertical support wall 54. The second horizontal wall 58 is positioned outboard of the first horizontal wall 56, the purpose of which will be explained further below. An outer vertical support wall 55 joins the two horizontal walls 56, 58. The inner vertical support wall is affixed to the roof flange 50 of the roof panels 64 by connecting panel 60 and rivets, welds or equivalent fasteners 62 fixedly attaching the connecting panels 60 with the first horizontal wall 56 and a roof flange 50. The connecting panels 60 are spaced as necessary along the length of the oven module 10, but not necessarily to each of the roof panels 64, and preferably not to any of the explosion panels 48.

As shown in FIG. 4, the explosion panels 48 are spaced lengthwise of the oven module 10 intermittently between roof panels 64. FIG. 4 shows these explosion panels 48 positioned between every roof panel 64. However, the explosion panels 48 may be positioned between every other roof panel 64, every second roof panel 64, or even every fourth roof panel 64 as necessary.

Figure 5:
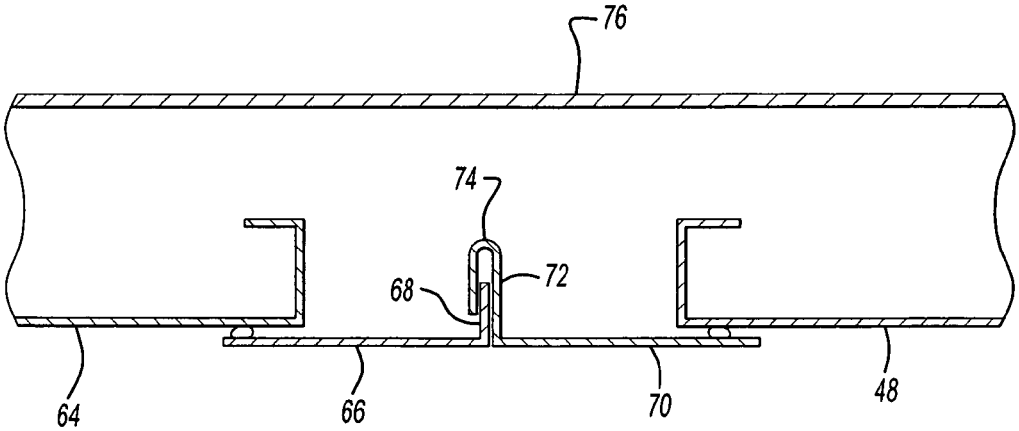
FIG. 5 shows a side, longitudinal, sectional view of intersection between the roof panel and the explosion panel.

FIG. 5 shows a functional interface between the roof panel 64 and the explosion panel 48. A first member 66 has an upwardly extending wall 68 is affixed to the roof panel 64. A second member 70 has a second upwardly extending wall 72 abutting the first upwardly extending wall 68 and is affixed to the explosion panel 48. The members 66, 68 are also preferably positioned between each explosion panel 48. The second upwardly extending wall 72 has a reverse bend 74 that overlaps the first upwardly extending wall 68 of the adjacent first member 66 thereby adjoining the first member 66 to the second member 70. For retention, a button punch (not shown) squeezes the reverse bend 74 to pinch the first upwardly extending wall 68. In the event of an explosion, the button punch releases and the explosion panel 48 lifts upwardly to provide a pressure release from the explosion thereby preventing structural damage to the oven module 10. Therefore, the seam formed between the explosion panels 48 and the wall panels 34 is preferably not welded to allow the explosion panels 48 to lift upwardly.

Referring again to FIG. 2A, each wall cladding panel 40 engages the second horizontal wall 58 and the outer vertical support wall 55 of the support member 52 and is retained as previously stated by the generally U-shaped channel 32 at the bottom. A roof cladding panel 76 rests upon the first horizontal wall 56 of the support member 52 so that all of the thermal insulating material 38 is now covered. A molding 78 (FIG. 1) conceals the seams formed between the support member 52, the wall cladding 40, and the roof cladding 76 and assists retaining the wall cladding panels 40 to the module 10.

Figure 6:
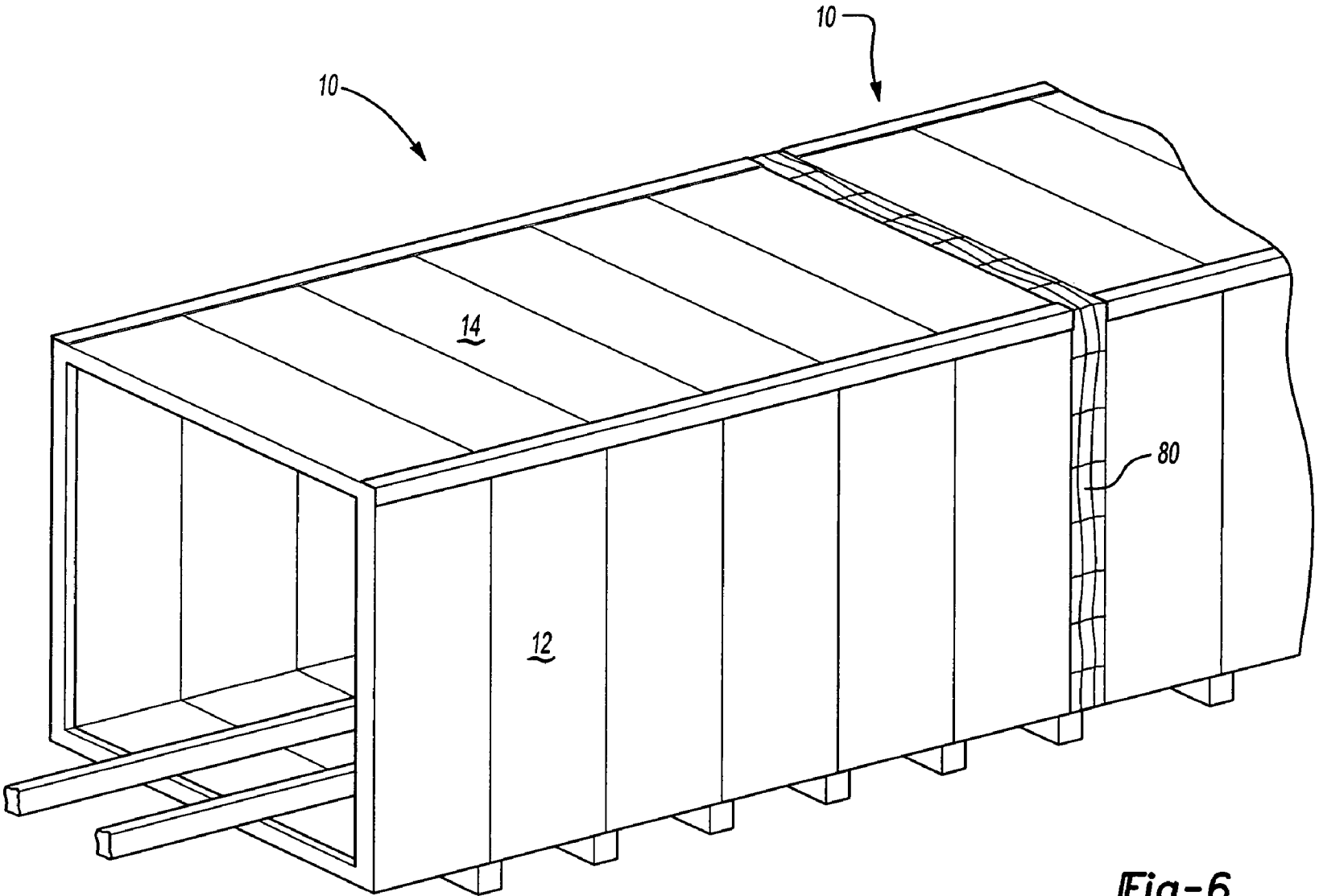
FIG. 6 shows a perspective view of adjacent oven modules.

As best shown in FIG. 6, expansion joints 80 are positioned between adjacent modules 10 as needed. Expansion joints may be positioned between every other module 10, every other second module 10, or every other third module 10 depending on the thermal expansion properties expected of the final oven design. The expansion joints 80 reduce the structural stress associated with the thermal expansion of the materials. Preferably, the expansion joint 80 is formed from a heat resistant fabric, however, other resilient materials may also be used.

The preferred oven 10 substrate material is aluminized steel. Aluminized steel is known to those of skill in the art to provide a more durable substrate than does galvanized steel and is less expensive than stainless steel.

Figure 7:
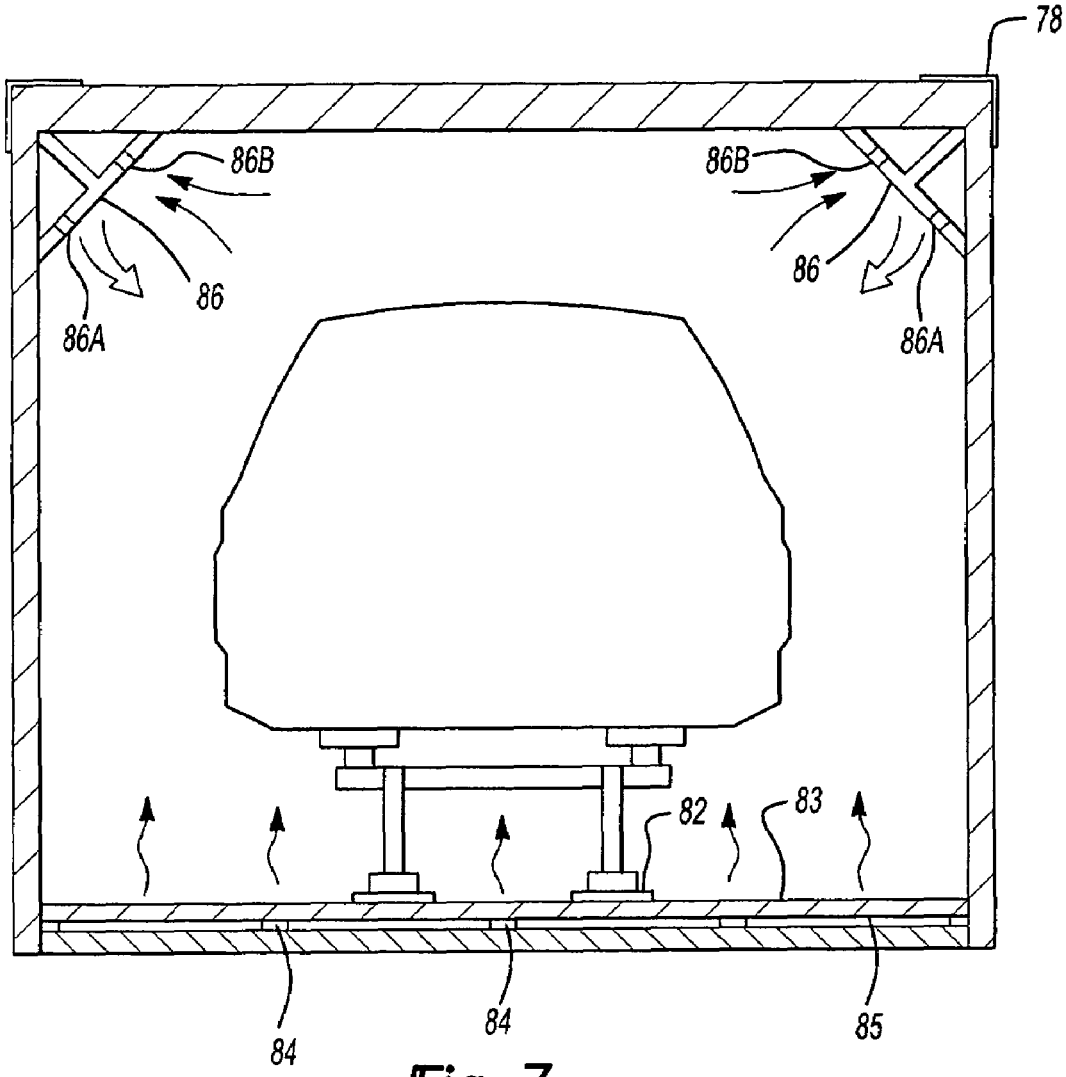
FIG. 7 shows a front view of the oven having a floor radiant heat assembly in place.

During the assembly process, the floor 16 is first assembled using the components set forth above. Upon welding one of the sets of seams 92 between each of the floor panels 24 and the walls 12 and another set of seams 94 between the walls 12 and the roof 14 provides an airtight seal. After the floor 16 is assembled, conveyor supports 82 are affixed to the upper surface as needed as best seen in FIG. 7. Additional ribbing (not shown) may also be welded to the underside of the panels 24 below the conveyor supports 82. Each of the side walls 12 are also manufactured separately using the components set forth above. Temporary braces, generally indicated at 96, secure the walls 12 in an upright position at appropriate spaced distances when the walls 12 are set upon the floor 16 in the overlapping relationship described above so that the walls 12 can be welded in place to provide an airtight seam. Once the walls 12 are place, the roof panels 48 are welded in place and the support members 52 are affixed to the roof panels 48.

Once all of the floor panels 24, the side wall panels 34, and the explosion panels 48 are in place, the thermal insulating material 38 is positioned on the exterior surfaces of the side wall panels 34 and the roof panels 64. After the insulating material 38 is in place, the wall cladding panels 40 are secured in the generally U-shaped channel 32 and upon the second horizontal wall 58 of the support member 52. Once the wall cladding panels 40 are in place, the roof cladding panels 76 are placed upon the roof panels 64 and the molding 78 is positioned to cover the seam between the wall cladding panels 40 and the roof cladding panels 76.

Each module is completed in a similar fashion and transported to the production painting facility where several modules are affixed together to form the entirety of the oven assembly. Depending upon the heating zone, the radiant heat ducts or convection heat ducts are put in place to either provide radiant or convection heat as desired.

As disclosed in U.S. Pat. No. 5,568,692, one preferred method of heating the oven through convection heat is from the floor 12. As shown in FIG. 7, a radiant wall 83 overlays the floor 12 and is supported by spacers 84 positioned between the radiant wall 83 and the floor 12. Heated air is pumped through a space 85 defined by the radiant wall 82 and the floor 12 via heated air inlet 19. The heated air transmits heat through the radiant wall 83 to heat the oven assembly 10. Optionally, air supply ducts 86 are included to provide fresh air and remove solvent laden air from the oven. Inlet ducts 86*a* deliver a small amount of air to the heating chamber, and air outlet ducts 86*b* quickly exhaust that air. These air supply ducts 86*a*, 86*b* provide circulation of a small amount of air to remove volatile organic components in the air from the solvent evaporated from the curing paint.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An oven assembly for drying paint on a product transported by a conveyor, comprising:

a plurality of modules positioned in a generally abutting relationship, wherein each of said modules includes a roof side walls, and a floor having a length and a width, said roof including roof panels spaced apart and fixedly attached between said side walls thereby supporting said side walls in a space relationship and relief panels disposed between said roof panels and being releasably retained to said roof panels thereby providing explosion relief to said assembly;

said floor formed from abutting floor panels reinforced by a plurality of support members spaced along said length of said floor and having a length greater than said width of said floor; and said side walls including an inner side wall panel disposed in an overlapping relationship with said floor and a side wall cladding panel supported by said support members along said width of said floor thereby concealing thermal insulating material disposed between said inner side wall panel and said side wall cladding panel.

2. An assembly as set forth in claim 1, wherein each said inner wall panel includes a flange extending outwardly therefrom at a generally 90 degree angle to define an enclosure and a thermal insulating material disposed therein.

3. An assembly as set forth in claim 1, further including a generally U-shaped channel extending along said length of said floor and supported by said support members for receiving said side wall cladding panel thereby retaining said side wall cladding panel to said assembly.

4. An assembly as set forth in claim 3, further including a radiant wall overlying said floor at a spaced location defining a heated air channel therebetween being fluidly connected to a source of heated air thereby heating said radiant floor.

5. An assembly as set forth in claim 1, further including air ducts affixed to at least one of said roof and said inner wall panel for providing air to said assembly.

6. An assembly as set forth in claim 1, further including a support member extending at least between said roof panels and providing an abutment surface for receiving said side wall cladding panels thereby retaining said side wall cladding panels to said assembly.

7. An assembly as set forth in claim 6, including roof cladding panels overlaying said roof at a spaced location thereby defining a space for receiving thermal insulating material.

8. An assembly as set forth in claim 1, wherein adjacent of said modules are adjoined by a flexible member thereby enabling said modules to expand and contract.

9. A method of manufacturing an oven assembly for drying paint on products transported on a conveyor, comprising the steps of:

assembling a floor from a plurality of insulating panels;

fixedly attaching inner wall panels to opposing sides of said floor;

fixedly attaching a roof to an opposite end of said inner side panels from said floor thereby defining module with a healing chamber within said floor, said inner wall panels, and said roof;

providing insulating material relative to said roof and said inner side wall panels and concealing said insulating material with cladding panels; and removably attaching braces to at least two of said roof, said inner side wall panels, and said floor to transport said module to a remote location.

10. The method as set forth in claim 9, further including the step of forming a first set of weld seams between said roof and said side walls and second set of weld seam between said side walls and said floor.

11. The method as set forth in claim 10, wherein said stop of removably attaching braces is further defined by affixing said braces over said first set of seams and said second set of seams thereby securing said assembly for transportation to a remote location.

12. The method as set forth in claim 9, further including the step of providing support members at spaced locations beneath said floor thereby supporting said assembly.

13. The method as set forth in claim 9, further including the step of providing a clasp for receiving said side wall cladding panels thereby retaining said side wall cladding panels to said assembly.

14. The method as set forth in claim 13, further including the step of fixedly attaching said clasp to said support members.

15. The method as set forth in claim 9, further including the step of providing a radiant wall at a spaced location over said floor thereby forming a hot air conduit between said floor and said radiant wall thereby providing heat to said assembly.

16. The method as set forth in claim 9, further including the step of providing an air duct fir providing air to said assembly and affixing said air duct to one of said floor, said side walls, and said roof.

17. The method as set forth in claim 9, further including the step of transferring a plurality of modules to the remote location.

18. The method as set forth in claim 9, further including the step of adjoining adjacent of said modules with a flexible member thereby enabling said modules to expand and contract.

19. The method as set forth in claim 18, further including the step of removing said support from said module when said module has arrive at the remote location.

20. The method as set forth in claim 9, further including the step of installing a conveyor in said heating chamber for transferring products through said assembly.

21. An oven assembly for drying paint on a product transported by a conveyor, comprising:

a plurality of modules positioned in a generally abutting relationship, wherein each of said modules includes a root side walls, and a floor having a length and a width with said floor formed from abutting floor panels;

a plurality of support members spaced along said length of said floor and having a length greater than said width of said floor with said support members reinforcing said floor;

an inner side wall panel of said side walls disposed in an overlapping relationship with said floor and a side wall cladding panel supported by said support members along said width of said floor thereby concealing thermal insulating material disposed between said inner side wall panel and said side wall cladding panel; and an air circulation device affixed to at least one of said roof and said inner wall panel for circulating air in said oven assembly.

22. An assembly as set forth in claim 21, wherein said inner side wall panel includes a flange extending outwardly therefrom at a generally 90 degree angle to define an enclosure and a thermal insulating material disposed therein.

23. An assembly as set forth in claim 21, further including a generally U-shaped channel extending along said length of said floor and supported by said support members for receiving said side wall cladding panel thereby retaining said side wall cladding panel to said assembly.

24. An assembly as set forth in claim 21, wherein said roof includes roof panels spaced apart and fixedly attached between said side walls thereby supporting said side walls in a space relationship.

25. An assembly as set forth in claim 21, further including relief panels disposed between said roof panels and being releasably retained to said roof panels thereby providing explosion relief to said assembly.

26. An assembly as set forth in claim 21, further including a radiant wall overlying said floor at a spaced location defining a heated air channel therebetween being fluidly connected to a source of heated air thereby heating said radiant floor.

27. An assembly as set forth in claim 21, wherein said air circulating device is further defined air ducts affixed to at least one of said roof and said inner wall panel for providing air to said oven assembly.

28. An assembly as set forth in claim 21, further including a support member extending at least between said roof panels and providing an abutment surface for receiving said side wall cladding panels thereby retaining said side wall cladding panels to said assembly.

29. An assembly as set forth in claim 21, including roof cladding panels overlaying said roof at a spaced location thereby defining a space for receiving thermal insulating material.

30. An assembly as set forth in claim 21, wherein adjacent of said modules are adjoined by a flexible member thereby enabling said modules to expand and contract.

31. An oven assembly for drying paint on a product transported by a conveyor, comprising:

a plurality of modules positioned in a generally abutting relationship, wherein each of said modules includes a roof, side walls, and a floor having a length and a width with said floor formed from abutting floor panels;

a plurality of support members spaced along said length of said floor and having a length greater than said width of said floor with said support members reinforcing said floor;

an inner side wall panel of said sick walls disposed in an overlapping relationship with said floor and a side wall cladding panel supported by said support members along said width of said floor thereby concealing thermal insulating material disposed between said inner side wall panel and said side wall cladding panel; and a channel extending along said length of said floor and supported by said support members to receive said side wall cladding panel thereby retaining said side wall cladding panel to said assembly.

32. An assembly as set forth in claim 31, wherein said channel includes a U-shaped configuration.

33. An assembly as set forth in claim 31, wherein said inner side wall panel includes a flange extending outwardly therefrom at a generally 90 degree angle to define an enclosure and a thermal insulating material disposed therein.

34. An assembly as set forth in claim 31, wherein said roof includes roof panels spaced apart and fixedly attached between said side walls thereby supporting said side walls in a space relationship.

35. An assembly as set forth in claim 31, further including relief panels disposed between said roof panels and being releasably retained to said roof panels thereby providing explosion relief to said assembly.

36. An assembly as set forth in claim 31, further including a radiant wall overlying said floor at a spaced location defining a heated air channel therebetween being fluidly connected to a source of heated air thereby heating said radiant floor.

37. An assembly as set forth in claim 31, including an air circulating device defined by air ducts affixed to at least one of said roof and said inner wall panel for providing air to said oven assembly.

38. An assembly as set forth in claim 31, further including a support member extending at least between said roof panels and providing an abutment surface for receiving said side wall cladding panels thereby retaining said side wall cladding panels to said assembly.

39. An assembly as set forth in claim 31, including roof cladding panels overlaying said roof at a spaced location thereby defining a space for receiving thermal insulating material.

40. An assembly as set forth in claim 31, wherein adjacent of said modules are adjoined by a flexible member thereby enabling said modules to expand and contract.

41. An oven assembly for drying paint on a product transported by a conveyor, comprising:

a plurality of modules positioned in a generally abutting relationship, wherein each of said modules includes a roof, side walls, and a floor having a length and a width, said roof including roof panels spaced apart and fixedly attached between said side walls thereby supporting said side walls in a space relationship and relief panels disposed between said roof panels and being releasably retained to said roof panels thereby providing explosion relief to said assembly;

said floor formed from abutting floor panels reinforced by a plurality of support members spaced along said length of said floor and having a length greater than said width of said floor;

said side walls including an inner side wall panel disposed in an overlapping relationship with said floor and a side wall cladding panel supported by said support members along said width of said floor thereby concealing thermal insulating material disposed between said inner side wall panel and said side wall cladding panel; and a radian wall overlying said floor at a spaced location defining a heated air channel therebetween being fluidly connected to a source of heated air thereby heating said radiant floor.

42. An oven assembly for drying paint on a product transported by a conveyor, comprising:

a plurality of modules positioned in a generally abutting relationship, wherein each of said modules includes a roof, side walls, and a floor having a length and a width;

said floor formed from abutting floor panels reinforced by a plurality of support members spaced along said length of said floor and having a length greater than said width of said floor;

said side walls including an inner wall panel disposed in an overlapping relationship with said floor and a side wall cladding panel supported by said support members along said width of said floor thereby concealing thermal insulating material disposed between said inner wall panel and said side wall cladding panel; and air duds affixed to at least one of said roof and said inner wall panel for providing air to said assembly.

* * * * *

UNITED STATES PATENT AND TRADEMARK OFFICE

CERTIFICATE OF CORRECTION

PATENT NO. : 6,990,749 B2
APPLICATION NO. : 10/798099
DATED : January 31, 2006
INVENTOR(S) : Bruce Roesler et al.

It is certified that error appears in the above-identified patent and that said Letters Patent is hereby corrected as shown below:

Column 5, line 57, please insert a comma before “roof” and “side walls.”

Column 6, line 56, please delete “stop” and insert --step--.

Column 7, line 10, please delete “fir” and insert --for--.

Column 7, line 22, please delete “arrive” and insert --arrived--.

Column 7, line 30, please delete “root” and insert --roof--.

Column 8, line 2, please delete “defined air ducts” and insert --defined as an air duct--.

Column 8, line 28, please delete “sick” and insert --side--.

Column 10, line 3, please delete “radian” and insert --radiant--.

Column 10, line 23, please delete “duds” and insert --ducts--.

Signed and Sealed this

Eighteenth Day of July, 2006

JON W. DUDAS
*Director of the United States Patent and Trademark Office*